US007347398B2

(12) United States Patent
Piguet et al.

(10) Patent No.: US 7,347,398 B2
(45) Date of Patent: Mar. 25, 2008

(54) DEVICE FOR TRANSFERRING A FOIL MATTER FROM OUTSIDE TO INSIDE OF A MACHINE

(75) Inventors: Michel Piguet, Renens (CH); Philippe Progin, Bulle (CH)

(73) Assignee: Bobst S.A. (CH)

( * ) Notice: Subject to any disclaimer, the term of this patent is extended or adjusted under 35 U.S.C. 154(b) by 204 days.

(21) Appl. No.: 11/110,530

(22) Filed: Apr. 19, 2005

(65) Prior Publication Data

US 2005/0236513 A1 Oct. 27, 2005

(30) Foreign Application Priority Data

Apr. 23, 2004 (CH) ..... 0717/04

(51) Int. Cl.
*B65H 23/32* (2006.01)

(52) U.S. Cl. ..... 242/615.21; 242/615.12; 226/196.1

(58) Field of Classification Search ..... 242/615.21, 242/615.12, 615.2, 566; 226/196.1, 113, 226/97.3
See application file for complete search history.

(56) References Cited

U.S. PATENT DOCUMENTS 2,495,909 A * 1/1950 Ross ..... 270/5.01
5,016,801 A 5/1991 Gilat et al. ..... 226/197
5,092,573 A 3/1992 Abreu ..... 270/52
5,423,468 A * 6/1995 Liedtke ..... 242/615.12
5,829,707 A * 11/1998 Lamothe ..... 242/538.2
6,047,922 A 4/2000 Michalik ..... 242/615.21
6,302,353 B1 * 10/2001 Motegi et al. ..... 242/615.12
6,418,851 B1 7/2002 Hartmann et al. ..... 101/485
2003/0047643 A1 3/2003 Lamothe ..... 242/615.21

FOREIGN PATENT DOCUMENTS

EP 0 739 721 4/1996
EP 0 741 096 4/1996

* cited by examiner

*Primary Examiner*—Peter M. Cuomo
*Assistant Examiner*—William E Dondero
(74) *Attorney, Agent, or Firm*—Ostrolenk, Faber, Gerb & Soffen, LLP

(57) ABSTRACT

Apparatus for transferring a foil matter from outside to inside of a machine. The apparatus has a longitudinal axis. The machine includes a frame comprising a first wall and a second wall. A window in the second wall. The outside and inside areas are separated by the first wall. The foil matter is held at a level of use outside by a first idling roller arranged in a frame. The device guides the foil matter so that its transfer from outside to inside is effected by at least one progressive turning of this foil matter around a second idling roller during passage of the foil matter through the window. The second roller intersects an edge of the window. The foil matter passes over a third idling roller angled with respect to the second one and to reoriented the foil matter along the longitudinal axis of the machine.

12 Claims, 1 Drawing Sheet

DEVICE FOR TRANSFERRING A FOIL MATTER FROM OUTSIDE TO INSIDE OF A MACHINE

BACKGROUND OF THE INVENTION

The present invention refers to a device for transferring a foil matter from outside a machine to inside the machine, more particularly a machine using stamping foils for manufacturing packaging. A foil may be any material having the characteristics and capabilities herein described.

Such a machine is used for the embossing and the transfer by pressure of film portions, preferably of metal, coming from such foils onto a substrate of paper, plastic material, or more particularly cardboard. These operations are, for example, carried out in a machine equipped with a platen press processing plate-like elements, such as sheets of cardboard, for the foil stamping of given patterns. These patterns coming from a stamping foil are led between the travelling plane of the plate-like elements and the upper beam of the press. In an intermittent vertical movement, the movable lower platen will press the stamping foil against each cardboard sheet between printing plates and corresponding counterparts in order to deposit the metallic layer of the stamping foil in correspondence with the patterns of the printing plates. Once the transfer has been carried out, the lower platen lowers and the stamped cardboard sheet is withdrawn from the platen press so as to leave the space for a new sheet. In the same lapse of time, the stamping foil is moved so that a new blank sheet is placed in correspondence with the printing plates. The diecutting and transfer operation of the foil can then be repeated.

Such a machine can also be used for diecutting cardboard sheets in a succession of operations each carried out in an adjacent station. This succession of operations generally comprises the infeed of the sheet into the press, its diecutting by tools arranged on the platen, the stripping of waste by specific tools and the delivery in stacks of the diecut sheet elements. In order to optimize the possibilities of such a machine, it is known to convert it so that the initial diecutting station becomes a stamping station for stamping foils by replacing the tools of the stripping station by a device for loading and unwinding stamping foil reels. Such a conversion is illustrated by the machine described in patent EP 741,096.

The arrangement of a foil loading and unwinding device in the stripping station is described in detail in patent EP 741,096. This device in particular comprises a pair of parallel vertical arms between which are arranged crossbars that are used as supports for a plurality of stamping foil reels. The foil widths are typically of the order of 5 to 20 cm.

Due to the transverse arrangement of the rotation axes of the reels with respect to the longitudinal axis of the machine, the unwinding of the foils takes place parallel to the travelling direction of the sheets to stamp. Once the foil is used, its skeleton should be gathered either by rewinding or by dividing it in its length into a plurality of tapes which will then be shredded in order to reduce the space requirement. This operation is realized simultaneously and continuously outside of the machine, such as described in patent EP 739,721. The deviation of the foils or tapes is generally obtained by the arrangement of idling rollers arranged at 45° on their passage, so that they can turn around these rollers in order to be deviated outside the machine. However, the arrangement of a plurality of idling rollers causes adjustment and space requirement problems not facilitating the access. Effectively, when preparing the machine, each of these idling rollers should be positioned on the one hand laterally with respect to the machine frame so that each of them is located on the path of the corresponding foil and on the other hand angularly so that the deviation of this foil can be made accurately. These adjustments, however, are often tedious to realize, especially since there is a large number of idling rollers. Moreover, in such a case, access to each of these idling rollers is also more difficult for the engine operator who must arrange and adjust these rollers in a narrow environment loaded with various bulky mechanisms. Finally, once all these elements have been positioned and adjusted, there should be access to a passage for placing the beginning of each the foils liable to travel in the machine.

Although the majority of the metallic layers deposited on the packaging can be realized from narrow foils, generally not exceeding 30 cm, sometimes wider stamping foils have to be used, typically of the order of 50 to 70 cm, or a plurality of narrow foils arranged side by side, having a total width which approaches this magnitude.

However, the use of wide reels raises problems of handling in particular. Because of their weight, it is obviously impossible to move these reels by the physical strength of one man for positioning them in the machine. Thus, lifting means should be used, such as hoists or small vehicles able to easily move heavy loads. However, the positioning of such reels by these means makes handling in the machine delicate, and sometimes even impossible, either because of lack of space around the machine or due to impossible access inside a machine which is not intended for such means.

To solve this problem, it has been proposed to locate the device for supporting and loading reels in a module arranged outside the machine so as to enable or facilitate access to it. Advantageously, such an unwinding module is arranged perpendicular to the longitudinal axis of the machine, and facing the stripping station. The stripping station is transformed for the occasion into a space provided with idling rollers arranged at 45° with respect to this same axis. Coming from this unwinding module, the foil or foils enter perpendicularly into the machine through an open window in one of the side walls of its frame, and then the foils are deviated at a right angle and toward the longitudinal axis of the machine.

Operating satisfactory, this arrangement is limited by the maximum width of the foils which cannot exceed the width of the open window in the wall of the frame. However, for dimensional reasons, it is generally hardly possible to arrange a window exceeding 70 cm in the space released by the stripping station. Depending on the design of the machine, this limiting value is determined by the useful maximum length of the stripping station. Since this station comprises permanent mechanical means, which obviously already occupy a part of the available space and due to the fact that this station is sandwiched between the stamping or diecutting station upstream and the delivery station downstream, it is impossible to enlarge the inner space or to extend this stripping station when transforming the machine from a diecutting press into a stamping press.

A new problem then arises if the width of the stamping foils is larger than the possible maximum width of the window in the machine frame. Effectively, for very large foils, typically more than 70 cm and up to the useful maximum width of the machine, of the order of 1 meter or even more, it is impossible to introduce such foils into a machine as proposed in the prior art. This problem is not solved by the use of a plurality of foils arranged, for example side by side, the total width of which would be larger than the width of the window. Being thus aware that it is impossible to enlarge the window of passage of the foil through the wall of the machine, the problem to be solved by the skilled man is to find a solution for passing a foil of approximately 1 m width through a narrower window, for example of only 70 cm width.

SUMMARY OF THE INVENTION

The apparatus of the invention is for transferring a foil matter from outside to inside of a machine. The apparatus has a longitudinal axis. The machine includes a frame comprising a first wall and a second wall. A window is in the second wall. The outside and inside areas are separated by the first wall. The foil matter is held at a level of use outside by a first idling roller arranged in a frame. The device guides the foil matter so that its transfer from outside to inside is effected by at least one progressive turning of the foil matter around a second idling roller during passage of the foil matter through the window. The second roller intersects an edge of the window. The foil matter passes over a third idling roller angled with respect to the second one.

To solve the problem described above, the present invention proposes a device for continuously transferring a foil matter through a window which is narrower than the width of this foil matter. In this context, it will be noted that the window for the passage of the foil matter is provided in one of the walls of the machine and its orientation is thus parallel or adjacent to the longitudinal axis of the machine. In order to ensure the possible transformations of this machine from a diecutting press into a stamping press and vice versa, the positioning and the removal of the object of the present invention are also accomplished to be of simple design, easy to accomplish while requiring a minimum of handling. Thus, the idle time, during which the machine will be immobilized, is advantageously reduced.

These aims are achieved owing to the present invention with a device for transferring a foil matter from outside to inside of a machine.

Other features and advantages of the present invention will become apparent from the following description of the invention which refers to the accompanying drawings.

BRIEF DESCRIPTION OF THE DRAWINGS

The invention will be more clearly understood from the study of a preferred embodiment given by way of non-limitative example and illustrated by the accompanying drawings, in which.

DETAILED DESCRIPTION OF EMBODIMENTS OF THE INVENTION

In the following description, the expressions operator's side and opposite operator's side will be used with reference to the usual position of the operator with respect to the machine. This choice avoids the use of the terms before and behind which depend on the observer's position with respect to the machine. Similarly, in order to avoid the terms left and right having the same drawback, the terms upstream and downstream will be used referring here to the travelling direction of the foil matter in the machine. Thus, in the limited scope of the present description, obviously this foil always travels from upstream to downstream. Further, foil matter is any material, paper, plastic, metal, etc. anything quite thin, in web form and sufficiently flexible to be redirected as described herein. Finally, note that the adjectives longitudinal and lateral or transverse as well as derived adverbs generally refer to the position of parts respectively oriented in the direction upstream-downstream and in the direction operator's side-opposite operator's side.

Figure 1:
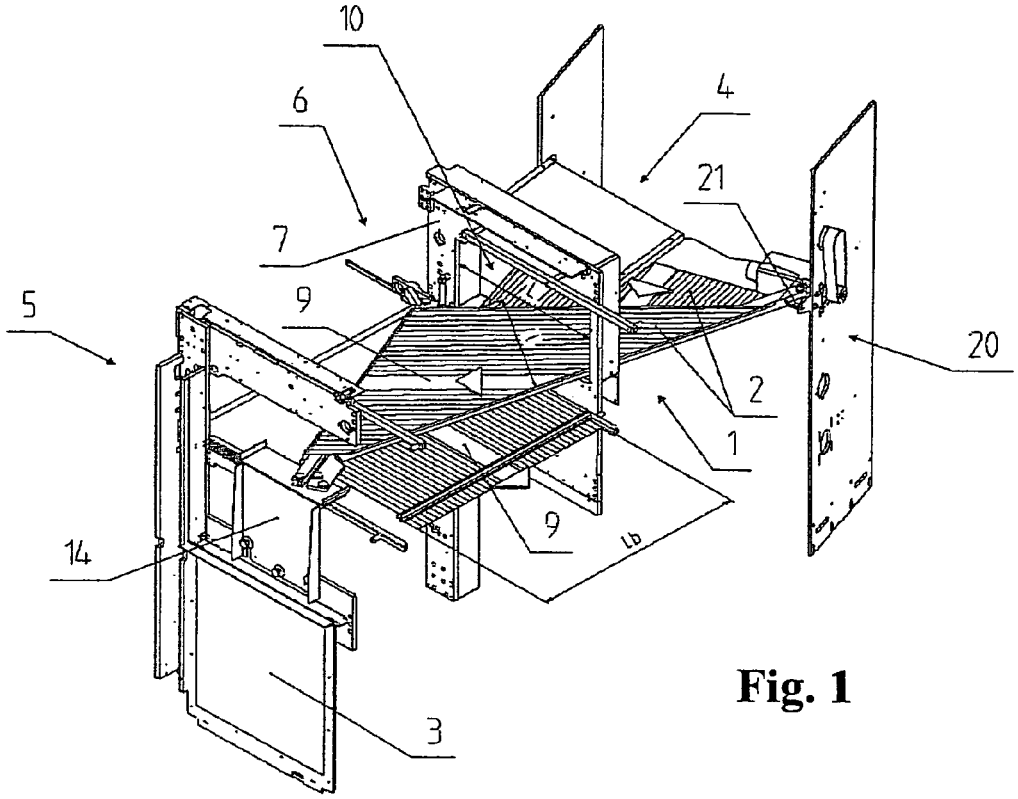
FIG. 1 shows a perspective view of the device of the invention which is to be installed in a machine part and on which travels a foil matter.
Figure 2:
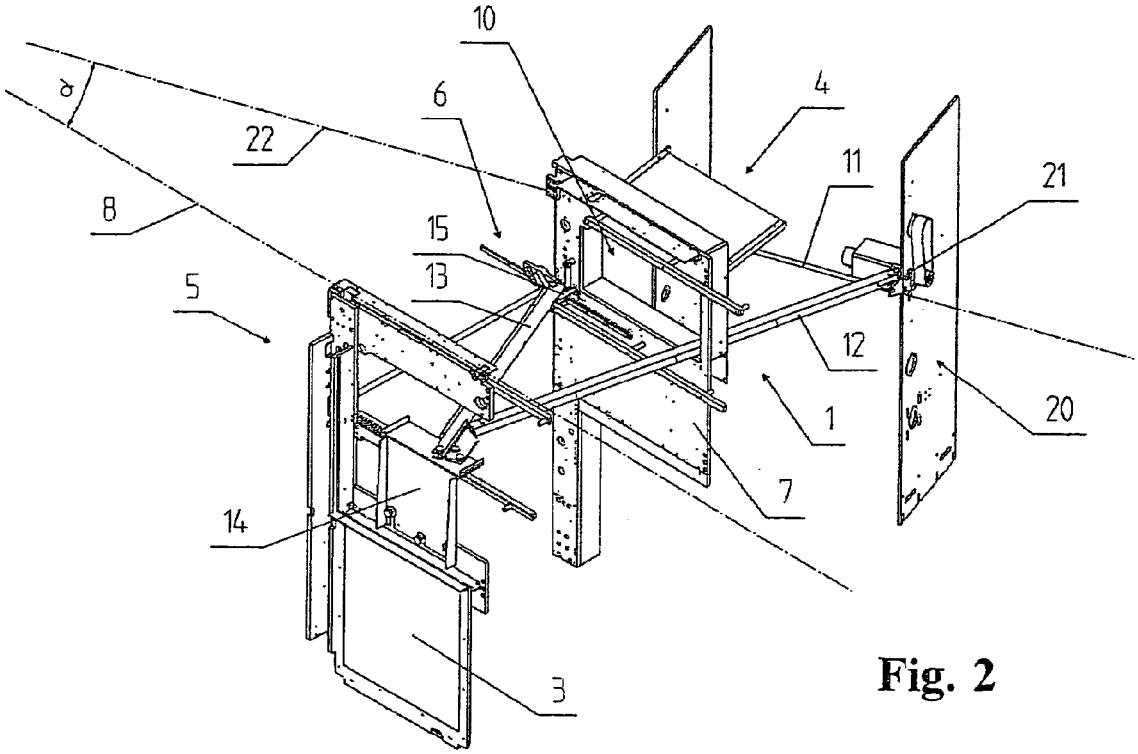
FIG. 2 is an identical view to FIG. 1 without the foil matter.

FIG. 1 is a perspective view of a device 1 for transferring a foil matter 2 between two areas, i.e. from outside 4 of a machine 5 to an inner area or inside 6 of the machine, separated by one of the walls of the machine frame. In FIGS. 1 and 2, this machine 5 or machine part is illustrated only showing some of its components, namely a first wall 3 located on the operator's side and a second wall 7 on the opposite operator's side. These walls constitute the frame of a station, commonly called stripping station with reference to a platen press normally used for diecutting plate-like elements (not shown). The travelling axis of these plate-like elements is shown in FIG. 2 by a dot-and-dash line corresponding to the longitudinal axis 8 of the machine. The path direction of the foil matter 2 from outside 4 towards inside 6 of the machine is given by the arrow-marked foil 9 shown in FIG. 1 on the travelling axis of the foil matter 2.

As better shown in FIG. 2, this path starts by a first idling roller 11, preferably horizontal, where the foil matter is supported at a level of use with respect to a window 10. This window is located between the outside 4 and inside 6 areas in the second wall 7. The foil matter 2 travels through this window. This window has a width L smaller than the width Lb of the foil matter. The first idling roller 11 is held in a frame 20 of a reel unwinder by means of squares 21 mounted against the walls of this frame. The orientation of the frame of this unwinder with respect to the machine 5 is shown by a second dot-and-dash line corresponding to the rotation axis 22 of the first idling roller 11. Preferably, the longitudinal axis 8 of the machine 5 and the rotation axis 22 are not parallel but intercept at an angle $\alpha$ corresponding to the orientation of the unwinder with respect to the machine 5.

The device of the present invention then guides the foil matter 2 so that the transfer from outside 4 to inside 6 is effected by at least one progressive turning of this foil matter on itself during its passage through the window 10. This turning is defined here as being progressive since it begins outside 4 and ends inside 6 or inversely according to the travelling direction of the foil matter given by the arrow-marked foil 9.

More particularly and according to the preferred embodiment, the foil matter is turned a first time on itself by a second idling roller 12 so that the rear side of this foil matter comes above and is apparent. This second idling roller crosses the window 10 and is fixed with one end to the frame 20 of the unwinder on one of the squares 21, and with the other end on the first wall 3 of the machine frame by means of a bent plate 14. As shown in the Figures, the end of the second idling roller 12 fastened to the frame 20 is fixed on the downstream wall of the unwinder frame and the opposite end is fixed on the first wall 3 of the machine so that the second idling roller 12 crosses the window preferably near its downstream edge.

After having passed around the second idling roller 12, the foil matter is directed towards a third idling roller 13 in order to be turned a second time so that the top side of the foil matter is again oriented upwards, as it was at the time of leaving the first idling roller 11. This third idling roller 13 is also aimed at redirecting the foil matter along the longitudinal axis 8 of and within the machine. This third idling roller is located downstream of the second idling roller and is held by its ends between the lateral walls 3 and 7 inside the machine 5. More precisely, the third idling roller is held in a horizontal position at one of its ends by the bent plate 14 and at the other end by a square 15 fixedly attached to the second wall 7 and preferably located near to the upstream edge of the window 10. The length of the third idling roller is such that it connects the walls 3 and 7 despite the non-perpendicular orientation of this roller with respect to the longitudinal axis of the machine.

The turning of one edge of the foil matter before passing the window 10 produces a significant reduction of the width L of the passage window with respect to the width $L_b$ of the foil matter. The theoretical limit of this reduction is given by the half-value of Lb. However, the more one approaches this limiting value, the longer is the second idling roller 12. Since the smallest apparent width of the partially turned foil matter is measured perpendicularly to the axis of the second roller 12, as shown in FIG. 1, it can be advantageous to arrange the rotation axis of this second roller 12 in a perpendicular position to the plane of the window 10, i.e. perpendicularly to the longitudinal axis 8 of the machine 5. This arrangement of the second idling roller 12 determines the orientation of the rotation axis 22 of the first idling roller 11 and consequently the value of the angle $\alpha$. However, the orientation of the first idling roller 11 according to an angle $\alpha$, preferably included between 0 and 90 degrees, causes with respect to the machine 5 a particular arrangement of the unwinder which can be perceived as being inopportune. Therefore a reasonable compromise should be found between the ratios of the reduction of the apparent width of the foil matter, the length of the second idling roller 12 and the inclination angle $\alpha$ of the first idling roller 11 with respect to the longitudinal axis 8 of the machine.

Optimizing this compromise is all the more interesting when also considering frictions of the foil matter on the idling rollers. Effectively, according to the length of these rollers and according to the winding angle of the foil matter around these rollers, these friction forces can be really serious. In order to reduce them to acceptable values, a particular material is used for the manufacture of at least one of these rollers, namely for the second and third idling rollers 12, 13. Such materials have a low coefficient of friction, either naturally or artificially if they have a sufficient porosity for the passage of a gaseous fluid able to create, for example, an air cushion between the idling roller and the foil matter.

The angle of deviation of the third idling roller 13 is determined by the condition aimed at aligning the travelling of the foil matter according to the longitudinal axis 8 of the machine. It is noted that once the angle $\alpha$ is determined, there is not really a reason to vary at will the turning angles of the foil matter beyond the optimum values. It is the main reason for which the idling rollers are rather not angularly adjustable but can on the contrary be fixed. Therefore, the design of the device 1 of the present invention is advantageously simplified while being less expensive and without interfering with the efficiency of the device. With this aim, it is also preferable to use knurled knobs for fixing the idling rollers on their support in order to simplify their mounting and their removal.

Advantageously, it will be noted that there is a direct correspondence between the positioning of the foil matter 2 on the first idling roller 11 and its positioning in machine once the foil matter is aligned according to the longitudinal axis 8. This feature is particularly interesting when the foil matter is not only composed of one foil but of a plurality of narrow tapes arranged side by side. In such a case, it is sufficient to laterally position these tapes along the first idling roller 11 such as they must be in machine to ensure a perfect correspondence with the various positions of the metallic layers on the plate-like elements. Therefore, the positioning and the adjustment of the foil matter in the machine are greatly simplified. This advantage is essentially due to the fact that the first idling roller 11 has a length at least equal to the useful maximum width of the machine 5, which width is also called web width by the skilled man, and that the second and third idling rollers 12, 13 also cover the web width of the machine despite their inclination with respect to the longitudinal axis 8. Due to this feature, it is easy to mark on the first idling roller 11 the limit edges on the operator's and opposite operator's side corresponding to the maximum size of the matter which can be passed into machine.

Advantageously, the arrangement in the device of the present invention also allows maximum release of the space still necessary for the introduction of the foil matter into machine. In fact, due to the arrangement in the inside area 6 of the machine of only two idling rollers 12, 13, it is not only possible to avoid the positionings and various adjustments required by use of a plurality of rollers, each operable to turn one tape, but also to rationalize the available inside area 6 by substantially reducing the number of elements to be arranged. This aspect is particularly advantageous for the places liable to be occupied by the passage and the stops of the moving members at fixed and previously determined places. Typically, such members can be gripper bars transversely mounted on a gripper bar chain and used for conveying plate-like elements into the various stations of the machine.

According to the present description, it should be noted that the device 1 has been described for transferring a foil matter from outside 4 of the machine 5 towards inside 6 of this machine. However, it should be mentioned, that the inverse path could, if required, perfectly be obtained with the same device, by symmetry by simply inverting the arrangement of the various idling rollers.

Furthermore, it is to be understood that the term foil matter covers both the use of a single foil of large width for example, as well as a plurality of foils or tapes arranged side by side with or without interstitial space. Although the machine in which the device of the present invention has been described clearly refers to a platen press processing plate-like elements, it will also be mentioned that the arrangement and the use of this device are by no way limited to such machines.

As illustrated in the preferred embodiment, the second and third idling rollers 12, 13 are arranged in the same plane, preferably in the same horizontal plane. However, another arrangement of these rollers would also be possible according to the path chosen for the foil matter. For the same reasons, it would also be possible to increase the number of idling rollers if necessary. In order to generalize the various possible cases, it will be mentioned that the transfer from outside 4 to inside 6 is effected by at least one progressive turning of the foil matter 2 during its passage through the window 10 and that the foil matter 2 is preferably turned a first time around the second idling roller 12, then at least a second time around at least a third idling roller 13 so that this foil matter can be oriented in machine parallel to the longitudinal axis 8.

Finally, it will be mentioned that the second and third idling rollers 12, 13 have upper generatrix lines located in the same horizontal plane and have preferably different diameters, namely the diameter of the second idling roller 12 being smaller than that of the third idling roller 13. Owing to this feature, it is possible on the one hand to always maintain the foil matter horizontally and, on the other hand, to benefit from a space separating the foil matter portion located upstream of the second idling roller 12 from that located downstream of the third idling roller 13. This space thus allows avoiding any friction of these two portions which, therefore, are no longer in the same plane.

Numerous improvements can be applied to the device of the present invention within the scope of the claims.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Apparatus for transferring a foil matter from an outside area outside of a machine to an inside area of the machine, the machine having a longitudinal axis and a frame, the frame comprising a first wall and a second wall spaced away from the first wall, the apparatus comprising:

a window located in the second wall and between the outside and the inside areas of the machine;

a roller frame comprising a first idling roller supported in the outside area outside of the machine, the first idling roller supporting the foil matter in the outside area; the first idling roller being inclined with respect to the window to guide the foil matter from the outside area to the inside area of the machine through the window such that the foil matter is progressively turned within the window.

2. The apparatus according to claim 1, wherein the roller frame further comprises:

a second idling roller extending from the outside area and the inside area through the window, the foil matter being turned around the second idling roller for a first time; and a third idling roller arranged within the inside area of the machine, the foil matter being turned around the third idling roller for a second time, at least the third roller being oriented such that after the foil matter is turned for the second time, the foil matter is reoriented to extend parallel to the longitudinal axis of the machine.

3. The apparatus according to claim 2, wherein the second and third idling rollers are so positioned and sized that they have upper generatrix lines located in the same horizontal plane.

4. The apparatus according to claim 2, wherein the second idling roller includes a first end secured to the roller frame and a second end secured to one of the first wall and the second wall of the frame of the machine, and the third idling roller includes at least two ends, each of the two ends of the third idling roller being secured to one of the first wall and the second wall of the frame of the machine.

5. The apparatus according to claim 2, wherein the window has side edges and the second idling roller is oriented to cross the window near to one of the side edges of the window.

6. The apparatus according to claim 2, wherein the first idling roller is oriented at an angular orientation angle $\alpha$ with respect to the longitudinal axis of the machine.

7. The apparatus according to claim 6, wherein the second idling roller is oriented perpendicular to the longitudinal axis of the machine.

8. The apparatus according to claim 7, wherein the third idling roller is angled toward the second idling roller in a direction from the outside area to the inside area of the machine.

9. The apparatus according to claim 2, wherein the second idling roller is oriented perpendicular to the longitudinal axis of the machine.

10. The apparatus according to claim 2, wherein at least one of said idling rollers comprises a porous material.

11. The apparatus according to claim 1, the apparatus being operable to convey the foil matter from the outside area towards the inside area of the machine.

12. The apparatus according to claim 1, wherein the foil matter comprises a first width, wherein the window comprises a second width, and wherein the second width is smaller than the first width.

* * * * *